US005172496A

United States Patent [19]

Vemi

[11] Patent Number: 5,172,496

[45] Date of Patent: Dec. 22, 1992

[54] SPIKED SHOE COVERING

[76] Inventor: Frank J. Vemi, 421 W. Ave. I, Lancaster, Calif. 93534

[21] Appl. No.: 412,084

[22] Filed: Sep. 25, 1989

[51] Int. Cl.[5] ..... A43B 1/10; A43B 5/00

[52] U.S. Cl. ..... 36/135; 36/7.5

[58] Field of Search ..... 36/135, 7.1 R, 7.5, 36/7.3, 7.4, 43

[56] References Cited

U.S. PATENT DOCUMENTS

| | | | |
|---|---|---|---|
| 1,958,107 | 5/1934 | Merrill et al. | 36/135 |
| 2,076,316 | 4/1937 | Beals, Jr. | 36/135 |
| 3,913,243 | 10/1975 | Arnold et al. | 36/135 |
| 3,987,510 | 10/1976 | Sbicca | 36/135 |
| 4,180,872 | 1/1980 | Chaikin | 36/7.3 |
| 4,476,638 | 10/1984 | Quacquarini et al. | 36/43 |
| 4,484,398 | 11/1984 | Goodwin et al. | 36/135 |
| 4,693,019 | 9/1987 | Kim | 36/135 |
| 4,872,273 | 10/1989 | Smeed | 36/7.3 |

*Primary Examiner*—Steven N. Meyers

*Attorney, Agent, or Firm*—Fish & Richardson

[57] ABSTRACT

A protective overshoe for use with a spiked shoe has a hard outersole a soft innersole formed with openings for accommodating each spike, and a flexible upper affixed to the outersole. The innersole is formed with transverse V-shaped grooves.

3 Claims, 1 Drawing Sheet

SPIKED SHOE COVERING

This invention relates generally to sports shoes and more specifically to protective devices for shoes having spiked members protruding from their soles.

BACKGROUND OF THE INVENTION

Many sports require the wearing of shoes having spikes or cleats (baseball, golf, track, etc.). These shoes provide extra traction while on the playing field but cause problems when the wearer wishes to walk on a hard surface. These hard surfaces may cause damage to the spikes or the spikes may cause damage to the surface. In addition, the spikes are designed to provide more traction on soft surfaces, such as dirt or grass, but give very little traction on hard surfaces, causing the wearer to fall if he walks on hard surfaces.

This invention allows the athlete to simply slip on an overshoe rather than having to change shoes before leaving the playing field. Other devices have been designed which eliminate the need to change from spiked shoes, however none accomplishes it as simply and comfortably as the present invention.

SUMMARY OF THE INVENTION

The present invention is an improved sports shoe protector which has been designed to overcome certain disadvantages of the prior art. This invention comprises a hard outer sole which is attached to a flexible upper. The outer sole may be attached to the upper with a band of material circumscribing the outer sole and wide enough to extend to cover the inner sole and a portion of the upper. A soft inner sole is placed inside the upper and the lower surface sits on top of the outer sole. This inner sole provides increased comfort. The inner sole is formed with openings designed to accomodate the spikes on the bottom surface of the shoe and is at least as thick as the length of the spikes to ensure that the spikes do not pierce the hard outer sole. To provide additional comfort, the inner sole is formed with transverse V-shaped indentations in its upper surface. The upper is formed with a zipper which is unzipped to remove or attach the overshoe and zipped to secure the overshoe to the shoe. This allows for simple and quick removal and attachment of the overshoe.

DETAILED DESCRIPTION

Figure 1:
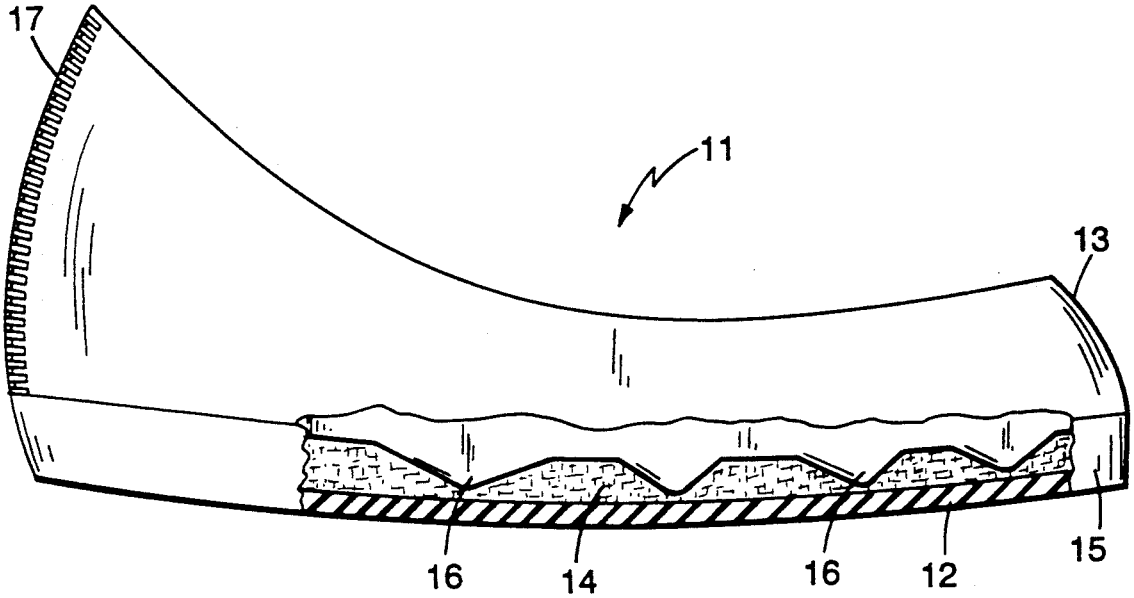
FIG. 1 is a side view of the overshoe, showing the outside as well as a cutaway view of a portion of the inside.
Figure 2:
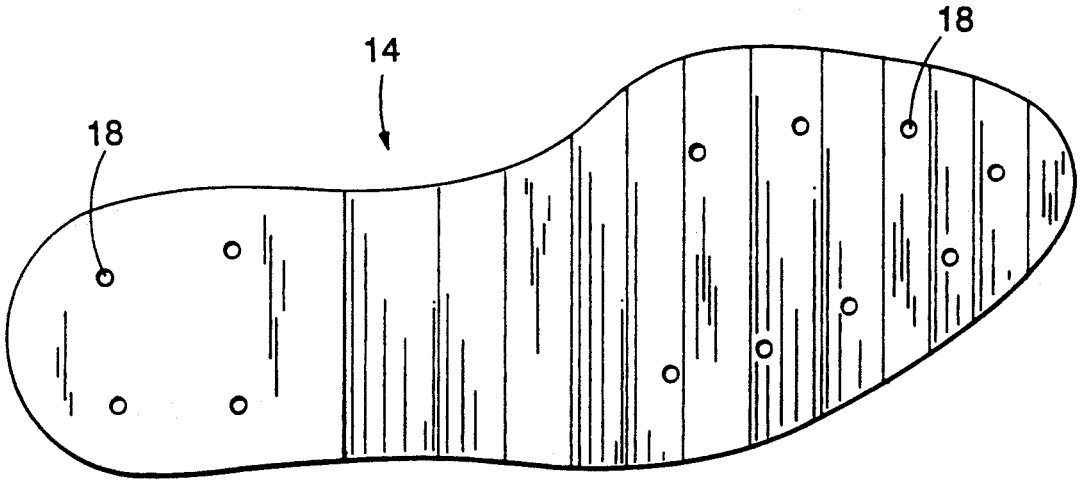
FIG. 2 is a top view of the inner sole.
Figure 3:
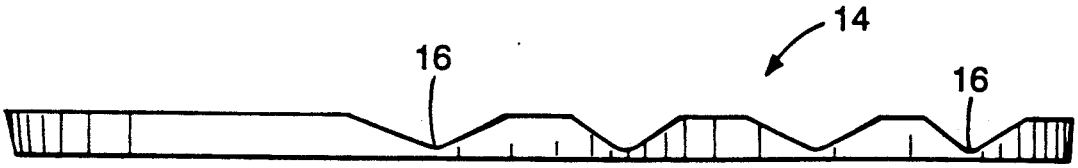
FIG. 3 is a side view of the inner sole.

Referring to the drawings, FIG. 1 shows a side view of the overshoe 11 having having a hard outer sole 12, flexible upper 13 and soft inner sole 14. The outer sole 12 is made from a hard material such as neoprene and is approximately ¼ inch thick. The upper 13 is made from a flexible material such as leather and may be lined if desired. FIG. 1 shows the upper 13 attached to the outer sole 12 by a one inch band of rubber 15. This band is wide enough to cover the ¼ inch outer sole 12, the ½ inch inner sole 14 and a portion (¼ inch) of the upper 13. The inner sole 14 is made from a soft material such as crepe, and is approximately ½ inch thick. The inner sole 14 is formed with transverse V-shaped indentations 16 which results in an overshoe which is comfortable to wear. Both the inner sole 14 and outer sole 12 are approximately the same shape as the sole of the sports shoe, and the upper 13 fits snugly around the upper portion of the sport shoe. This particular embodiment has a zipper 17 on the heel section of the upper 13 which allows the wearer to slip the overshoe on and zip it up the back, attaching it securely to the spiked shoe. FIG. 2 shows a top view of the inner sole 14. The inner sole 14 is formed with openings 18 which accomodate the spikes on the sole of the sports shoe. FIG. 3 is a side view of the inner sole 14 showing the V-shaped indentations 16.

Other embodiments are within the scope of the claims.

What is claimed is:

1. A protective overshoe for use in combination with a sports shoe having spiked members extending downward from a sole section of said sports shoe comprising:

a hard outer sole;

a soft inner sole having an upper surface and a lower surface and formed with openings to accommodate each spiked member, said inner sole being thick enough so that said spiked members do not pierce said hard outer sole;

a flexible upper portion affixed to said outer sole;

said inner sole being inside said upper portion and seated with said lower surface on said outer sole;

said overshoe being detachably securable to said sports shoe in surrounding relationship with said spiked members seated in said openings, wherein said inner sole upper surface is formed with transverse V-shaped grooves.

2. A combination as recited in claim 1 wherein said outer sole is attached to said upper portion with a band of material circumscribing the outer sole and wide enough to extend to cover the inner sole and a portion of the upper portion.

3. A combination as recited in claim 1 wherein said upper portion has a heel portion that is formed with a zipper for attaching said overshoe to said sports shoe.

* * * * *